US005238132A

United States Patent [19]

Shibaoka et al.

[11] Patent Number: 5,238,132

[45] Date of Patent: Aug. 24, 1993

[54] GLASS PRESSURE-VESSEL FOR A CATHODE RAY TUBE

[75] Inventors: Kazuo Shibaoka, Itami; Takao Miwa, Yokkaichi; Masashi Uehara, Suzuka; Toshio Akimoto; Katsuya Kamisaku, both of Yokkaichi, all of Japan

[73] Assignee: Nippon Sheet Glass Co., Ltd., Osaka, Japan

[21] Appl. No.: 988,725

[22] Filed: Dec. 10, 1992

[30] Foreign Application Priority Data

Dec. 10, 1991 [JP] Japan ..... 3-325463

[51] Int. Cl.[5] ..... H01J 29/81

[52] U.S. Cl. ..... 220/2.1 A; 313/477 R

[58] Field of Search ..... 220/2.1 R, 2.1 A, 2.3 A, 220/200; 313/402, 477 R, 407

[56] References Cited

U.S. PATENT DOCUMENTS 4,030,627 6/1977 Lentz ..... 270/2.1 A
4,656,388 4/1987 Strauss ..... 220/2.1 A
4,686,415 8/1987 Strauss ..... 220/2.1 A
5,107,999 4/1992 Canevazzi ..... 313/477 R
5,151,627 9/1992 Van Nes et al. ..... 313/477 R

*Primary Examiner*—Joseph Man-Fu Moy
*Attorney, Agent, or Firm*—Woodcock Washburn Kurtz Mackiewicz & Norris

[57] ABSTRACT

A glass pressure vessel for a cathode ray tube comprising a concave glass and a rectangular glass back-plate to be bound to the concave glass with glass Frit, satisfies the following inequalities, $$1000\ W/(Lt_2) \geqq 2.8$$

$$t_1 \geqq 0.8\ t_2$$

where $t_1$ (mm) is the thickness of the concave glass, L (mm) and $t_2$ (mm) are the length of the short side and the thickness of the back-plate, respectively, and W (mm) is a bond width in which the flange portion of the concave glass and the back-plate are bonded together.

9 Claims, 2 Drawing Sheets

GLASS PRESSURE-VESSEL FOR A CATHODE RAY TUBE

BACKGROUND OF THE INVENTION

1. Field of the Invention

This invention relates generally to a glass pressure-vessel, and particularly, but not exclusively, to a glass pressure-vessel for a cathode ray tube of a flat type, the tube being sealed up for keeping its internal pressure low.

2. Description of the Prior Art

Disclosed, for example, in Japanese Laid Open Patent No. 2-289444 is a glass pressure-vessel suitable for use with a TV of a thin type. The pressure vessel is produced by such a process as to heat and bend a glass plate to obtain a concave glass and, then, to bond the concave glass and a glass back-plate together with glass frit to obtain a closed vessel. It is noted that many electron guns are accommodated in the closed vessel.

However, in such pressure vessel, the central part of the glass back plate is deformed to be inwards convex due to low internal pressure thereof, so that the pressure withstanding strength of its bonded part decreases due to tensile stress produced in the bonded part. Particularly, in a glass pressure-vessel for a large-sized image display, in which the area of its flat portion is large, the withstanding strength decreases very much, so that the reliance upon the sealing ability of the glass pressure-vessel is placed low.

Moreover, the glass pressure-vessel accommodating the electron guns and so forth necessary for displaying images are usually sealed under low pressure and in a heating state to keep its interior and the articles therein dry, so that thermal stress is produced in the concave glass and glass back-plate, and particularly in the glass pressure-vessel having the large flat portion, the excessively high stress is produced in the sealed portion, so that the sealed portion is apt to be damaged.

In addition, the glass pressure-vessel for a cathode ray tube has a problem that it is undesirably colored (hereinafter, referred to "browning phenomenon"), since the electron beam being accelerated to about 10–30 kV is continuously applied to its inner surface.

Furthermore, the glass pressure-vessel for a cathode ray tube would have a high temperature and high voltage due to the continuous application of the electron beam. So that dielectric breakdown between the concave glass and the glass back-plate would be occurred, if the conventional concave glass with low electrical resistivity at high temperature are used for. Accordingly, such concave glass is not suitable for a cathode ray tube.

OBJECT AND SUMMARY OF THE INVENTION

Accordingly, it is an object of the present invention to provide a glass pressure-vessel which is not easily damaged and the sealed portion of which can withstand enough the internal pressure thereof.

This invention was made as the result of carefully examining influence of the width of a sealed portion, the dimensions of a concave glass and a glass back-plate, the kind of glass frit, and so forth upon the sealed portion of the vessel, and one aspect of this invention is such that the concave glass comprises a substantially rectangular flat portion, a side wall portion connected to the flat portion, and an annular flange portion, the outer periphery of which is substantially rectangular; the concave glass and the glass back-plate whose outer periphery is similar in size to that of the flange portion are bonded together in a predetermined width with glass frit to obtain the vessel; and the following inequalities are satisfied, where $t_1$ (mm) is the thickness of the concave glass, L (mm) is the length of the short side of the concave glass and the glass back-plate, $t_2$ (mm) is the thickness of the glass back-plate, and W (mm) is the width of the sealed portion.

$$1000\ W/(Lt_2) \geqq 2.8$$

$$t_1 \geqq 0.8\ t_2$$

It is preferable that the thickness $t_1$ is about 5 mm when the glass pressure-vessel is used as a comparatively small cathode ray tube of a flat type, for example, having a size of about six inches, and it is preferable that $t_1$ is more than 8 mm to guarantee a pressure withstanding strength necessary for practical use, when the vessel is used as a large-sized cathode ray tube of a flat type, for example, having a size of 11–20 inches.

Especially, this invention is suitable for applying a glass pressure-vessel for a cathode ray tube, which satisfies the combination with the following inequalities, where l (mm) is the length of the long side of said concave glass, and H (mm) is the depth of said concave glass, $$100 \leqq L \leqq 530$$

$$25.45t_1 - 52.7 < L < 25.4t_1 - 1.8$$

$$1.3L \leqq l \leqq 3.0L$$

$$20 \leqq H \leqq 40.$$

Moreover, it is preferable that compressive stress of more than 25 kgf/mm$^2$ is produced in adjacent portions of respective surfaces of the concave glass and the glass back-plate, so as to stably obtain a necessary pressure withstanding strength of the glass pressure-vessel, and well known as means for producing the compressive stress are means of chemical strengthening, wherein the concave glass and glass back-plate are made to touch molten salt of potassium irons or the like, whose ionic radii are larger than those of sodium ions, and sodium ions in the concave glass and glass back-plate are exchanged with potassium ions in the molten salt, for example, potassium nitrate.

In this invention, glass frit having bending strength of 260 kgf/cm$^2$, manufactured by Iwaki Glass Manufacturing Co., and put on the market in the name of IWF029B is used for example, but other well known frits are, of course, usable. However, it is preferable that the frit to be used has the bending strength of more than 500 kgf/cm$^2$ in order to increase the pressure withstanding strength of the glass pressure-vessel.

Moreover, it is preferable that the corner part of the flange portion of the concave glass is made larger in width than the rest of the flange portion, because the sealed portion is apt to be easily damaged particularly on the corner part, so that it is necessary to strengthen the corner part.

At that time, it is preferable that the width of the corner part is 1.6 times as large as or larger than the thickness of the concave glass, and the width of a part of the flange portion excluding the corner part is 1.3 times as large as or larger than the thickness of the concave glass, so as to improve the pressure withstanding strength without increasing the thickness of the concave glass.

It is preferable that the thickness of the concave glass is selected within range of 3–15 mm as the size of the flat portion changes. For example, when the flat portion of the concave glass is shaped into a rectangular form and the length of its diagonal is 152.4 mm (6 inches), the thickness of the concave glass is selected to be 3 mm. The thickness of the concave glass should be selected so that stress produced in the flange portion may be less than 200 kgf/cm$^2$ at the time when the inside of the concave glass is made vacuous.

By the way, in performing the above-mentioned chemical strengthening, it is preferable that either following compositions A, B or C is used for the starting material of the concave glass, in view of preventing the browning phenomenon and dielectric breakdown of the glass pressure-vessel.

Composition A (wt %) $SiO_2$:70.0–7.3, $Ai_2O_3$:1.0–1.8, MgO:1.0–4.5, CaO:7.0–12.0, $Na_2O$:12.0–14.0, $K_2O$:-0–1.5, and $Fe_2O_3$:0.08–0.14

Composition B (wt %) $SiO_2$:64.0–75.0, $Ai_2O_3$:1.5–2.0, MgO:0–5.0, CaO:6.5–9.0, $Li_2O$:0.5–2.5, $Na_2O$:7.0–12.0, $K_2O$:1.6–5.0, BaO+SrO+ZrO:0–10.0, and $CeO_2$:0–0.5

Composition C (wt %) $SiO_2$:64.0–72.0, $Ai_2O_3$:1.5–2.0, MgO:3.0–4.0, CaO:6.5–9.0, $Li_2O$:0.5–1.5, $Na_2O$:8-.5–10.5, $K_2O$:2.1–3.0, and BaO+SrO+ZrO:4.5–10.0

The composition A is for the conventional soda line silica glass, which can be produced by the float process (i.e. produced on the molten metal of tin). Accordingly, it is possible to obtain a concave glass having a good surface smoothness (suitable for the cathode-ray tube) without polishing process, by utilizing the composition A.

A concave glass made from the composition B or C has a advantage that insulation between the concave glass and the glass back-plate can be stably maintained due to the higher electrical resistivity than that of the composition A. In fact, the electrical resistivity at 150° C. is more than $1\times10^{10}$ Ω cm for composition B and more than $1\times10^{10.7}$ Ω cm for composition C, while about $1\times10^{9}$ Ω cm for composition A.

Moreover, the concave glass made from the composition C has a further advantage that it has a browning resistance layer with high mechanical strength, wherein said layer can be formed within short period by above-mentioned ion exchanging process. For example, the concave glass with compressive stress of more than 25 kgf/mm$^2$ can be obtained by the ion exchanging process from the starting material of the composition C with 90–150 minutes at 500° C., 90–300 minutes at 490° C. or 150–360 minutes at 460° C.

It is preferable for each of the compositions A, B and C that a part adjacent to the surface of the concave glass has a layer being characterized by the following inequalities, $$0.30 \leqq Na_2O/(Na_2O+K_2O)\ (\text{mol }\%) \leqq 0.75.$$

Because, such layer causes the mechanical strength of the concave glass to much increase, and has a superior function for preventing the browning phenomenon.

By the way, a part where the concave glass is colored varies depending on a accelerating voltage of the electron beam being applied to the glass. For example, if the accelerating voltage is about 10 kV, most electrons stop at a place where the depth from the surface of the glass is within the range of 0.5–1.5 μm, and the concave glass is colored within this range. If the voltage is about 20 kV, the glass is colored within the range of 1.0–3.5 μm, and if the voltage is about 30 kV, the glass is colored within the range of 2.0–6.5 μm. Accordingly, conditions for ion exchanging process would be defined in accordance with the accelerating voltage of electron beam.

Other features and advantages of the invention will be apparent from the following description taken in connection with the accompanying drawings.

DETAILED DESCRIPTION OF PREFERRED EMBODIMENTS

Preferred embodiments of the present invention will be described in the following with reference to the appended drawings.

A. General Figures of a Concave Glass and a Glass Back-plate

Example 1

Figure 1:
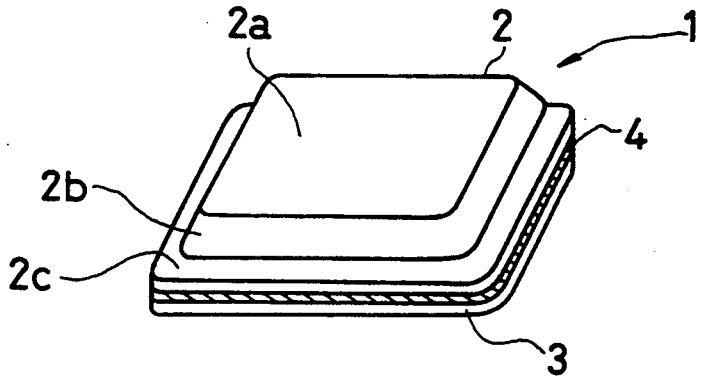
FIG. 1 is a general perspective view of a glass pressure-vessel for a cathode ray tube according to an embodiment of this invention.
Figure 2:
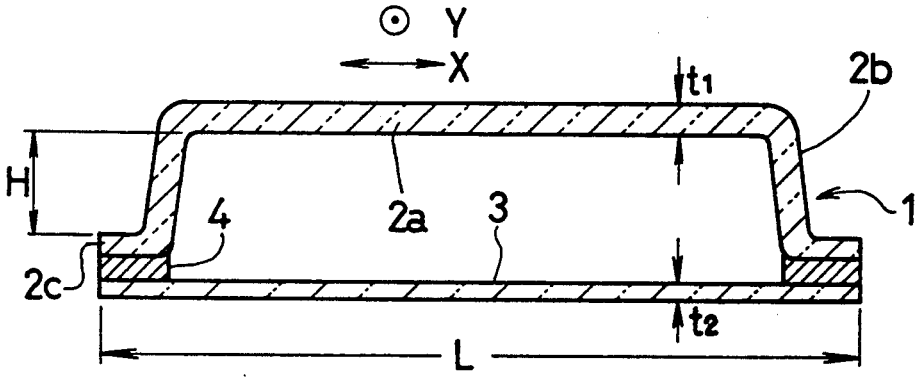
FIG. 2 is a sectional view of the glass pressure-vessel of FIG. 1.

As shown in FIGS. 1 and 2, a glass pressure-vessel A embodying the invention is a vessel used as a cathode ray tube whose internal pressure is low, and is made in such a way as to bond a concave glass 2 and a glass back-plate 3 together with glass frit 4.

The concave glass 2 is obtained by heating and bending a soda-lime float glass having a thickness $t_1$ of 15 mm, and comprises a substantially rectangular flat portion 2*a* four corners of which are rounded, a side wall portion 2*b* connected to the flat portion 2*a*, and an annular flange portion 2*c* the outer periphery of which is shaped into a substantially rectangular form.

Figure 5:
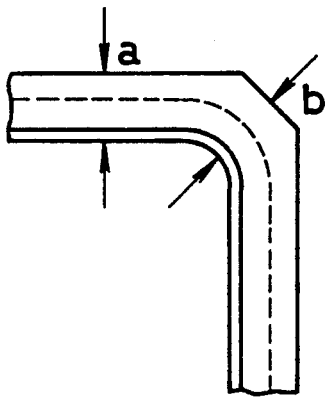
FIG. 5 is a plan view, on enlarged scale, of the flange portion of FIG. 3.

The dimensions of the concave glass 2 are 369 mm and 489 mm in respective directions of x and y in FIG. 2, and the depth H is 40 mm. The width b of the corner parts of the flange portion (FIG. 5) are 18 mm, and are the same as the width a of the rest of the flange portion.

The concave glass 2 is dipped in molten salt of potassium nitrate to exchange sodium irons in the glass with potassium ions in the molten salt and, as the result, compressive stress of 60 kgf/mm$^2$ is produced in a part adjacent to the surface of the concave glass 2.

The glass back-plate 3 is made of a soda-lime float glass and its thickness $t_2$ is 15 mm. Its dimensions are 379 mm (length denoted by L in FIG. 2) and 499 mm in respective x and y directions in FIG. 2. The same ion exchange is performed with respect to the glass back-plate and, as the result, compressive stress of 60 kgf/mm$^2$ is produced in a part adjacent to the surface of the glass back-plate.

Figure 3:
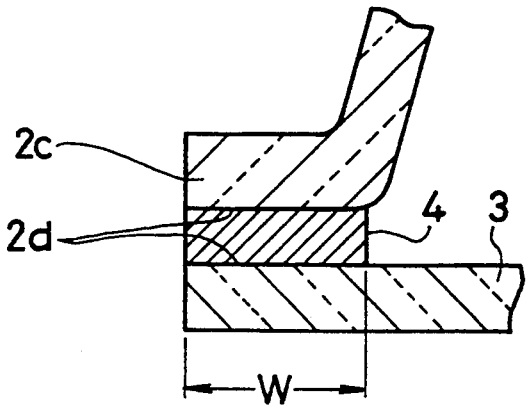
FIG. 3 is a sectional view, on an enlarged scale, of the flange portion of the glass pressure-vessel of FIG. 1.

The concave glass 2 and the glass back-plate 3 are bonded together in their bonded faces 2d (FIG. 3) with glass frit 4 having bending strength of 260 kgf/cm$^2$ (manufactured by Iwaki Glass Manufacturing Co., put on the market in the name of IWF029B, and hereinafter designated as Frit I). It is noted that the bond width W formed between the bonded faces 2d is 16 mm.

The bonding process is performed at temperature of 450° C., and the compressive stress produced in the parts adjacent to the surfaces of the concave glass 2 and the glass back-plate 3 falls within range of 25–30 kgf/mm$^2$. The value (1000 W/Lt$_2$) of the glass pressure-vessel A amounts to 2.81, and thickness $t_1$ is equal to thickness $t_2$.

The internal pressure of the glass pressure-vessel A is low, so that the atmospheric pressure of about 1 kgf/cm$^2$ is always exerted on the glass pressure-vessel A.

Water pressure is exerted several times on the glass pressure-vessel A from outside thereof in order to examine its pressure withstanding strength, that is, the water pressure under which the sealing ability of the vessel A is lost. The average pressure withstanding strength obtained is 3.0 kgf/cm$^2$ and, at that time, the sealed portion of all the examined vessels A are damaged. When the glass frit 4 denoted by Frit I is replaced by Frit II (having the bending strength of 400 kgf/cm$^2$), the average pressure withstanding strength amounts to 4.1 kgf/cm$^2$.

Examples 2–4

The average pressure withstanding strength is examined upon respective glass pressure-vessels B, C and D. In those glass pressure-vessels, the length of the concave glass 2 measured in the x direction, thickness $t_1$, the length of the short side of the glass back-plate, thickness $t_2$, bond width W are different from those of the glass pressure-vessel A.

Comparative examples 1–3

The average pressure withstanding strength is examined upon glass pressure vessel E whose bond width W is 12 mm, glass pressure-vessel F whose thickness $t_1$ is 10 mm, and glass pressure-vessel G whose thickness $t_1$ is 12 mm, and compared with glass pressure-vessel A whose dimensions are the same as those of glass pressure-vessel E, F and G except for the dimensions described above on the respective glass pressure-vessels E, F and G.

Table 1 is made to compare the test results obtained from Examples 1–4 and Comparative examples 1–3. Further, a graphical representation of a value (100 W/Lt$_2$)-average pressure withstanding strength relationship is given in FIG. 4.

Figure 4:
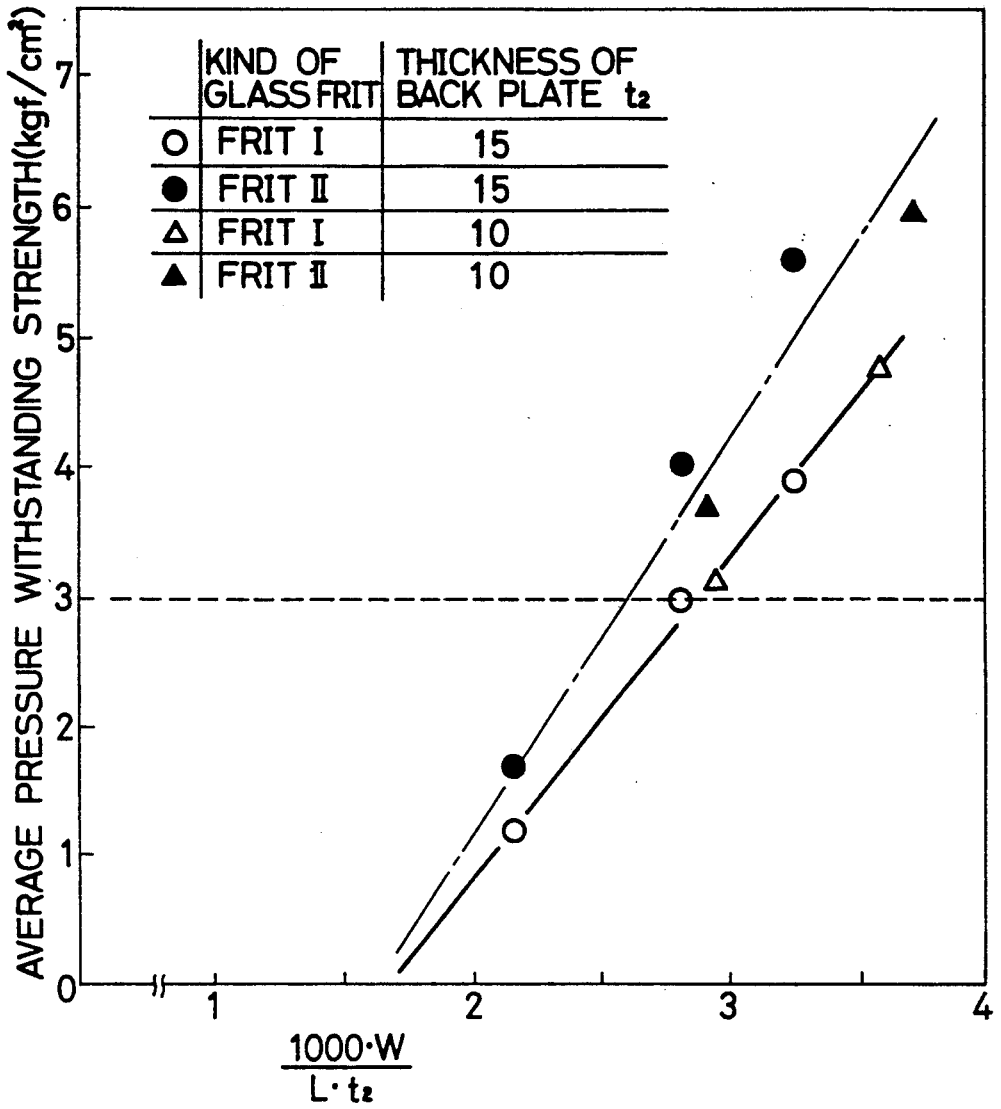
FIG. 4 is a graphical representation of average pressure withstanding strength present in the glass pressure-vessel of FIG. 1 and in a glass pressure-vessel provided for comparison with that of FIG. 1.

According to Table 1 and FIG. 4, it will be understood that when the following inequalities are satisfied, the pressure withstanding strength of the glass pressure-vessel amounts to a value necessary for practical use, that is 3 kgf/cm$^2$.

$$1000\ W/(Lt_2) \geqq 2.8$$

$$t_1 \geqq 0.8\ t_2$$

B. Shape of the Flange Portion

Examples 5–7

The pressure withstanding strength is examined upon glass pressure-vessel H. The dimensions of concave glass 2 and glass back-plate 3, and the bond width W of the glass pressure-vessel H are the same as those of glass pressure-vessel A, except that width b of the corner part of the flange portion and width a of the rest of the flange portion are 26 mm and 22 mm, respectively. Further, upon glass pressure-vessel J whose dimensions are the same as those of glass pressure-vessel H, except that width b of the corner part and width a of the rest are changed to 30 mm and 25 mm, respectively, and glass pressure-vessel K whose dimensions are the same as those of glass pressure-vessel H, except that widths b and a are changed to 18 mm and 15 mm, respectively, the average pressure withstanding strength is examined In the tests of Examples 5–7, only Frit I is used as the glass frit 4.

Examples 8–10

A glass material is melted to obtain a glass gob. The glass material contains 59.14% weight of $SiO_2$, 1.08% weight of $Al_2O_3$, 0.98% weight of MgO, 2.00% weight of CaO, 11.02% weight of $Na_2O$, 2.88% weight of $K_2O$, 9.72% weight of BaO, 9.74% weight of SrO, 0.02% weight of $Fe_2O_3$, 0.28% weight of $CeO_2$, 046% weight of $TiO_2$ and 5.74% weight of $ZrO_2$.

A concave glass 2 is made of the glass gob in such a well known manner as to use a metallic mold. In the concave glass 2, thickness $t_1$ is 5 mm, and the lengths measured in x and y directions in FIG. 2 are 138 mm and 178 mm, respectively. The depth of this concave glass is 21 mm. Further, width b of the corner part and width a of the rest of the flange portion 2c are 9.4 mm and 7.0 mm, respectively.

Compressive stress is produced on a part adjacent to the surface of the concave glass by means of the same ion exchange process as is used in Example 1, and the concave glass is bound, with Frit I, to a glass back-plate 3 made of said glass gob, whose thickness $t_2$ is 5 mm and whose lengths measured in x and y directions in FIG. 2 are 142 mm (the length denoted by L) and 183 mm, respectively. It is noted that bond width W is 6 mm. In glass pressure-vessel M thus obtained for Example 8, $t_1$ equals to $t_2$ and (1000 W/Lt$_2$) is 8.45.

In glass pressure-vessel N used in Example 9, thickness $t_1$ of the concave glass 2 is 10 mm, width b of the corner part of the flange portion 2c is 23 mm, and width a of the rest of the flange portion 2c is 15 mm. The other dimensions of the glass pressure-vessel N are the same as those of the glass pressure-vessel M.

In glass pressure-vessel P used in Example 10, width b of the corner part of the flange portion 2c is 8 mm, and width a of the rest of the flange portion 2c is 5 mm. The other dimensions are the same as those of the glass pressure-plate M. The average pressure withstanding strength is examined upon each of the glass pressure-vessels M, N and P in the same manner as is used in Example 1.

Comparative Examples 4–7

In glass pressure-vessel Q used in Comparative example 4, widths a and b of the flange portion are 15 mm, and the other dimensions are the same as those of the glass pressure vessel A. In glass pressure-vessel R userd in Comparative example 5, width b of the corner part and width a of the rest of the flange portion are 13 mm and 15 mm, respectively, and the other dimensions are the same as those of the glass pressure vessel A. In glass pressure-vessel S used in Comparative example 6, widths b and a of the flange portion are 5 mm, and the other dimensions are the same as those of the glass pressure-vessel A. In glass pressure-vessel used in Comparative example 7, width b of the corner part of the flange portion 2c is 4 mm, width a of the rest of the flange portion 2c is 5 mm, and the other dimensions are the same as those of the glass pressure-vessel M.

The average pressure withstanding strength of each of the glass pressure-vessels Q, R, S and T is examined in the same manner as is used in Example 1.

The average pressure withstanding strength obtained from Examples 1 and 5–10 and Comparative examples 4–7 are shown in Table 2. According to Table 2, it is preferable that width b of the corner part of the flange portion is larger than width a of the rest in order to improve the pressure withstanding strength. Particularly, it is preferable that width b of the corner part is 1.6 times as large as or larger than the thickness $t_1$ of the concave glass 2 and width a of the rest is 1.3 times as large as or larger than the thickness $t_1$ of the concave glass 2.

In the above embodiments, the flat portion 2a of the concave glass 2 is shaped into a rectangular form, four corners of which are rounded, but the flat portion may be shaped into a square form.

C. Glass Composition

Examples 11–23

Electrical resistivity, browning resistance and mechanical strength have been examined (Table 4 ) upon each of the thirteen sample glass plates which are made from the starting material of the compositions stated in Table 3. These thirteen sample plates have been produced in 5 mm thickness by above-mentioned float process and been ion-exchanged in the potassuim nitrate at adequate conditions, before said three physical constants are measured.

On the examination of the sample plates, logarithm (log $\rho$) of volume resistivity $\rho$ at 150° C. has been measured as electrical resistivity. Also, change of transmittance ($\Delta T$=transmittance before applying electron beam of 40 $\mu A/cm^2$ being accelerated to about 10 kV in 100 hours-transmittance after applying electron beam) of light with wavelength of 400 nm has been measured as browning resistance. Further, compressive stress in part adjacent to the surface of the plate has been measured as mechanical strength, by a polarizing microscope.

Examples 24–25

Distribution of concentrations (in mol % and wt %) of $Na_2$ and $K_2O$ from the surface of the glass plate toward the inside have been measured for Sample 6A (Table 5) which is obtained from the plate of Sample 6 (Table 3) by ion-exchanging process in potassium nitrate for 180 minutes at 460° C., and for Sample 6B (Table 6) which is obtained by ion-exchanging process for 360 minutes at 460° C., by an X-ray micro-analyzer having resolution of about 0.5 $\mu$m.

Referring to Table 5, it is apparent that a layer being characterized by the inequalities, $0.30 \leqq Na_2O/(Na_2O+K_2O)$ (mol %)$\leqq 0.75$, wherein such layer has much increased mechanical strength and has a superior function for preventing the browning phenomenon, exists in the range of between about 0.9 $\mu$m and about 4.8 $\mu$m. Accordingly, the concave glass of Sample 6A is suitable for preventing the browning phenomenon, in case electron beam being accelerated to about 10 kV is applied.

Referring to Table 6, a layer being characterized by said inequalities exists in the range of between about 1.5 $\mu$m and about 7 $\mu$m. Accordingly, the concave glass of Sample 6B is suitable for preventing the browning phenomenon, in case electron beam being accelerated to about 30 kV is applied. Thus, it is preferable that conditions for ion-exchanging process is defined in accordance with the accelerating voltage of electron beam.

The average pressure withstanding strength is examined upon a glass pressure-vessel made of the plate of Sample 6A, which has been produced in the same manner as the glass pressure-vessel A and has the dimensions just the same as it. The result is that 3.0 $kgf/cm^2$ for Frit I, and 4.1 $kgf/cm^2$ for Frit II, which are equivalent to those of Example 1.

If the glass pressure-vessel for a cathode ray tube of this invention is whose internal pressure is low, an image display having high pressure-withstanding strength will be obtained. Particularly, if it is used as a large-sized cathode-ray tube, it will have a pressure withstanding strength necessary for practical use.

As many apparently widely different embodiments of this invention may be made without departing from the spirit and scope thereof, it is to be understood that the invention is not limited to the specific embodiments thereof except as defined in the appended claims.

TABLE 1

| Example No. | Type of the Pressure Vessel | Glass Back-Plate: Short Side (L) × Long Side (mm) | Glass Back-Plate: Thickness $t_2$ (mm) | Concave Glass: Length × Width × Depth (mm) | Concave Glass: Thickness $t_1$ (mm) | $t_1/t_2$ | Bond Width W (mm) | $1000\ W/Lt_2$ | Average Pressure Withstanding Strength ($kgf/cm^2$): Frit I[2)] | Average Pressure Withstanding Strength ($kgf/cm^2$): Frit II[2)] |
|---|---|---|---|---|---|---|---|---|---|---|
| Ex. 1 | A | 379 × 499 | 15 | 369 × 489 × 40 | 15 | 1.0 | 16 | 2.81 | 3.0 | 4.1 |
| Ex. 2 | B | 379 × 499 | 15 | 373 × 493 × 40 | 15 | 1.0 | 18.5 | 3.25 | 3.9 | 5.6 |
| Ex. 3 | C | 240 × 314 | 10 | 236 × 310 × 40 | 10 | 1.0 | 7 | 2.92 | 3.1 | 3.7 |
| Ex. 4 | D | 244 × 328 | 10 | 240 × 314 × 40 | 10 | 1.0 | 9 | 3.69 | 4.8 | 6.0 |
| Comp. Ex. 1 | E | 369 × 489 | 15 | 363 × 483 × 40 | 15 | 1.0 | 12 | 2.17 | 1.2 | 1.7 |
| Comp. Ex. 2 | F | | 15 | | 10 | 0.7 | 16 | 2.81 | 1.6 | 2.3 |
| Comp. Ex. 3 | G | | 15 | | 12 | 0.8 | 16 | 2.81 | 2.6 | 3.5 |

[1)]Glass frit having a bending strength of about 260 $kgf/cm^2$

[2)]Glass frit having a bending strength of about 500 $kgf/cm^2$

TABLE 2

| Example No. | Type of the Pressure Vessel | Widths of the Flange Portion: Corner Part b (mm) | Widths of the Flange Portion: The Rest a (mm) | 1000 W/Lt$_2$ | Thickness of the Concave Glass t$_1$ (mm) | b/t$_1$ | a/t$_1$ | Average Pressure Withstanding Strength (kgf/cm$^2$) |
|---|---|---|---|---|---|---|---|---|
| Ex. 1 | A | 18 | 18 | 2.81 | 15 | 1.2 | 1.2 | 3.0 |
| Ex. 5 | H | 26 | 22 | 2.81 | 15 | 1.7 | 1.5 | 4.1 |
| Ex. 6 | J | 30 | 25 | 2.81 | 15 | 2.0 | 1.7 | 4.8 |
| Ex. 7 | K | 18 | 15 | 2.81 | 15 | 1.2 | 1.0 | 2.9 |
| Ex. 8 | M | 9.4 | 7 | 8.45 | 5 | 1.9 | 1.4 | 7.4 |
| Ex. 9 | N | 23 | 15 | 8.45 | 10 | 2.3 | 1.5 | 6.4 |
| Ex. 10 | P | 8 | 5 | 8.45 | 5 | 1.6 | 1.0 | 5.1 |
| Comp. Ex. 4 | Q | 15 | 15 | 2.81 | 15 | 1.0 | 1.0 | 2.3 |
| Comp. Ex. 5 | R | 13 | 15 | 2.81 | 15 | 0.9 | 1.0 | 1.9 |
| Comp. Ex. 6 | S | 5 | 5 | 8.45 | 5 | 1.0 | 1.0 | 4.9 |
| Comp. Ex. 7 | T | 4 | 5 | 8.45 | 5 | 0.8 | 1.0 | 3.8 |

TABLE 3

| Sample No | Glass Composition (weight %) | | | | | | | | | | | | | | | |
|---|---|---|---|---|---|---|---|---|---|---|---|---|---|---|---|---|
| | $SiO_2$ | $Al_2O_3$ | $LiO_2$ | $Na_2O$ | $K_2O$ | SrO | BaO | ZnO | MgO | CaO | $Fe_2O_3$ | ZrO | $TiO_2$ | $CeO_2$ | $Sb_2O_3$ | $As_2O_3$ |
| Sample 1 | 72.8 | 1.7 | 0.7 | 10.6 | 2.8 | 0.0 | 0.0 | — | 3.8 | 7.5 | 0.08 | — | — | — | — | — |
| Sample 2 | 71.9 | 1.7 | 0.7 | 10.5 | 2.8 | 0.0 | 0.0 | — | 3.8 | 8.5 | 0.08 | — | — | — | — | — |
| Sample 3 | 72.3 | 1.7 | 0.7 | 9.1 | 4.9 | 0.0 | 0.0 | — | 3.8 | 7.5 | 0.08 | — | — | — | — | — |
| Sample 4 | 68.7 | 1.6 | 0.6 | 10.3 | 2.7 | 0.0 | 5.0 | — | 3.7 | 7.3 | 0.08 | — | — | — | — | — |
| Sample 5 | 69.7 | 1.6 | 0.5 | 8.7 | 2.3 | 0.0 | 5.0 | — | 3.7 | 8.2 | 0.08 | — | — | — | — | — |
| Sample 6 | 64.7 | 1.6 | 0.6 | 10.0 | 2.6 | 0.0 | 9.7 | — | 3.6 | 7.1 | 0.08 | — | — | — | — | — |
| Sample 7 | 66.3 | 1.6 | 0.5 | 8.1 | 2.1 | 0.0 | 9.7 | — | 3.6 | 8.0 | 0.08 | — | — | — | — | — |
| Sample 8 | 73.3 | 1.7 | 1.3 | 9.3 | 2.8 | 0.0 | 0.0 | — | 3.9 | 7.6 | 0.08 | — | — | — | — | — |
| Sample 9 | 72.8 | 1.7 | 1.3 | 7.8 | 4.9 | 0.0 | 0.0 | — | 3.8 | 7.5 | 0.08 | — | — | — | — | — |
| Sample 10 | 69.1 | 1.7 | 1.3 | 9.0 | 2.7 | 0.0 | 5.0 | — | 3.7 | 7.3 | 0.08 | — | — | — | — | — |
| Sample 11 | 70.2 | 1.7 | 1.1 | 7.5 | 2.3 | 0.0 | 5.0 | — | 3.7 | 8.3 | 0.08 | — | — | — | — | — |
| Sample 12 | 65.2 | 1.6 | 1.3 | 8.7 | 2.7 | 0.0 | 9.8 | — | 3.6 | 7.1 | 0.08 | — | — | — | — | — |
| Sample 13 | 66.9 | 1.6 | 1.0 | 7.0 | 2.1 | 0.0 | 9.8 | — | 3.6 | 8.0 | 0.08 | — | — | — | — | — |

TABLE 4

| Sample | Ion Exchange Process: Temperature (°C.) | Ion Exchange Process: Time (min) | Volume Resistivity log ρ (Ω cm) | Change of Transmittance ΔT (%) | Compressive Stress kg/mm$^2$ |
|---|---|---|---|---|---|
| Sample 1 | 460 | 180 | 10.00 | 33 | 59 |
| Sample 2 | 460 | 180 | 10.25 | 30 | 62 |
| Sample 3 | 460 | 180 | 10.65 | 35 | 56 |
| Sample 4 | 490 | 300 | 10.70 | 19 | 50 |
| Sample 5 | 460 | 180 | 10.85 | 17 | 52 |
| Sample 6 | 490 | 300 | 11.40 | 14 | 47 |
| Sample 7 | 460 | 180 | 11.55 | 13 | 49 |
| Sample 8 | 460 | 180 | 10.40 | 26 | 55 |
| Sample 9 | 460 | 180 | 11.08 | 29 | 51 |
| Sample 10 | 490 | 300 | 11.10 | 15 | 48 |
| Sample 11 | 460 | 180 | 11.40 | 13 | 50 |
| Sample 12 | 490 | 300 | 11.80 | 8 | 43 |
| Sample 13 | 460 | 180 | 12.05 | 7 | 45 |

TABLE 5

| Component | 460° C., 3 hr Depth from the Surface (μm): 0 | 0.1 | 0.3 | 0.5 | 1 | 2 | 3 | 4 | 5 | 6 | 7 |
|---|---|---|---|---|---|---|---|---|---|---|---|
| $Na_2O$ mol % | 1.88 | 2.43 | 2.71 | 3.1 | 3.45 | 4.86 | 6.3 | 7.85 | 9.01 | 9.73 | 10 |
| $K_2O$ | 9.33 | 9.25 | 9.13 | 8.97 | 7.8 | 6.28 | 4.87 | 3.62 | 2.61 | 2.01 | 1.81 |
| $Na_2O$ wt % | 1.84 | 2.38 | 2.65 | 3.03 | 3.38 | 4.76 | 6.17 | 7.69 | 8.82 | 9.53 | 9.8 |
| $K_2O$ | 15.45 | 15.32 | 15.12 | 14.85 | 12.92 | 10.39 | 8.06 | 5.99 | 4.33 | 3.33 | 3 |
| $Na_2O/(Na_2O + K_2O)$ mol % | 0.17 | 0.21 | 0.23 | 0.26 | 0.31 | 0.44 | 0.56 | 0.68 | 0.78 | 0.83 | 0.85 |

TABLE 6

| Component | 460° C., 6 hr Depth from the Surface (μm): 0 | 0.1 | 0.3 | 0.5 | 1 | 2 | 3 | 4 | 5 | 6 | 7 |
|---|---|---|---|---|---|---|---|---|---|---|---|
| $Na_2O$ mol % | 2.44 | 2.42 | 2.42 | 2.42 | 3.08 | 4.18 | 5.55 | 7.2 | 7.92 | 8.69 | 9.02 |
| $K_2O$ | 10.23 | 10.19 | 9.89 | 9.5 | 8.81 | 6.39 | 5.35 | 4.4 | 3.8 | 3.11 | 2.81 |
| $Na_2O$ wt % | 2.39 | 2.37 | 2.37 | 2.37 | 3.01 | 4.09 | 5.44 | 7.05 | 7.75 | 8.51 | 8.83 |
| $K_2O$ | 16.94 | 16.87 | 16.37 | 15.72 | 14.58 | 10.58 | 8.86 | 7.29 | 6.29 | 5.15 | 4.65 |

TABLE 6-continued

| Component | 460° C., 6 hr Depth from the Surface (μm) | | | | | | | | | | |
|---|---|---|---|---|---|---|---|---|---|---|---|
| | 0 | 0.1 | 0.3 | 0.5 | 1 | 2 | 3 | 4 | 5 | 6 | 7 |
| $Na_2O/(Na_2O+K_2O)$ mol % | 0.19 | 0.19 | 0.2 | 0.2 | 0.26 | 0.4 | 0.51 | 0.62 | 0.68 | 0.74 | 0.76 |

What is claimed is:

1. In a glass pressure-vessel for a cathode ray tube wherein a concave glass comprises a substantially rectangular flat portion, a side wall portion connected to the flat portion, and an annular flange portion whose outer periphery is substantially rectangular, and the flange portion of the concave glass is bound, with glass frit and in a predetermined bond width, to a rectangular glass back-plate whose periphery is in accordance with the outer periphery of the flange portion, the combination with the following inequalities being satisfied, where $t_1$ (mm) is the thickness of said concave glass, L (mm) is the length of the short side of said concave glass and said glass back-plate, $t_2$ (mm) is the thickness of the said glass back-plate, and W (mm) is said bond width, $$1000\ W/(Lt_2) \geqq 2.8$$

$$t_1 \geqq 0.8\ t_2.$$

2. A pressure vessel according to claim 1, wherein the combination with the following inequalities being satisfied, where l (mm) is the length of the long side of said concave glass, and H (mm) is the depth of said concave glass, $$100 \leqq L \leqq 530$$

$$25.45t_1 - 52.7 < L < 25.4t_1 - 1.8$$

$$1.3L \leqq l \leqq 3.0L$$

$$20 \leqq H \leqq 40.$$

3. A pressure vessel according to claim 1, wherein compressive stress of more than 25 kgf/mm$^2$ is produced in parts adjacent to respective surfaces of said concave glass and said glass back-plate, by exchanging sodium ions in said concave glass and said glass back-plate with potassium ions in the molten salt.

4. A pressure vessel according to claim 1, wherein the corner part of said flange portion is larger in width than the rest of said flange portion.

5. A pressure vessel according to claim 3, wherein said width of the corner part is 1.6 times as large as or larger than the thickness of said concave glass, and said width of the rest of the flange portion is 1.3 times as large as or larger than the thickness of said concave glass.

6. A pressure vessel according to claim 4, wherein the thickness of said concave glass lies within range of 3–15 mm.

7. A pressure vessel according to claim 3, wherein said concave glass is made from a starting material which contains 70.0–73.0% weight of $SiO_2$, 1.0–1.8% weight of $Al_2O_3$, 1.0–4.5% weight of MgO, 7.0–12.0% weight of CaO, 12.0–14.0% weight of $Na_2O$, 0–1.5% weight of $K_2O$, and 0.080–0.14% weight of $Fe_2O_3$, and the part adjacent to the surface of said concave glass has a layer being characterized by the following inequalities, $$0.30 \leqq Na_2O/(Na_2O+K_2O)\ (\text{mol }\%) \leqq 0.75.$$

8. A pressure vessel according to claim 3, wherein said concave glass is made from a starting material which contains 64.0–75.0% weight of $SiO_2$, 1.5–2.0% weight of $Al_2O_3$, 0–5.0% weight of MgO, 6.5–9.0% weight of CaO, 0.5–2.5% weight of $Li_2O$, 7.0–12.0% weight of $Na_2O$, 1.6–5.0% weight of $K_2O$, 0–10.0% weight of BaO+SrO+ZrO, and 0–0.5% weight of $CeO_2$, and the part adjacent to the surface of said concave glass has a layer being characterized by the following inequalities, $$0.30 \leqq Na_2O/(Na_2O+K_2O)\ (\text{mol }\%) \leqq 0.75.$$

9. A pressure vessel according to claim 3, wherein said concave glass is made from a starting material which contains 64.0–72.0% weight of $SiO_2$, 1.5–2.0% weight of $Al_2O_3$, 3.0–4.0% weight of MgO, 6.5–9.0% weight of CaO, 0.5–1.5% weight of $Li_2O$, 8.5–10.5% weight of $Na_2O$, 2.1–3.0% weight of $K_2O$, 4.5–10.0% weight of BaO+SrO+ZrO, and the part adjacent to the surface of said concave glass has a layer being characterized by the following inequalities, $$0.30 \leqq Na_2O/(Na_2O+K_2O)\ (\text{mol }\%) \leqq 0.75.$$

* * * * *